United States Patent [19]

Hughes

[11] 4,082,872

[45] Apr. 4, 1978

[54] FLOWER DECORATION

[76] Inventor: James L. Hughes, 4946 Duebber Dr., Cincinnati, Ohio 45238

[21] Appl. No.: 728,314

[22] Filed: Sep. 30, 1976

[51] Int. Cl.[2] ..... A41G 1/00

[52] U.S. Cl. ..... 428/24; 131/231; 220/1 H; 431/125; 431/289; 431/295

[58] Field of Search ..... 428/7, 15, 17, 21, 23, 428/24, 25, 26; 220/1 H; 131/231, 238; 431/125, 126, 289, 295; D27/11, 16, 22; 156/61

[56] References Cited

U.S. PATENT DOCUMENTS

| | | | |
|---|---|---|---|
| D. 100,024 | 6/1936 | Hutchinson | D27/22 |
| D. 125,780 | 3/1941 | Miller | 131/231 X |
| 687,245 | 11/1901 | Kruel | 428/24 X |
| 2,428,116 | 9/1947 | Jensen | 131/231 X |
| 2,653,616 | 9/1953 | Selgas | 220/1 H |
| 2,888,816 | 6/1959 | Kanost | 428/7 X |
| 3,002,308 | 10/1961 | Decamp | 63/29 UX |
| 3,050,619 | 8/1962 | Abramson | 428/23 X |
| 3,386,590 | 6/1968 | Gretz | 431/126 X |

FOREIGN PATENT DOCUMENTS

| | | | |
|---|---|---|---|
| 1,216,543 | 11/1959 | France | 428/26 |

*Primary Examiner*—George F. Lesmes
*Assistant Examiner*—Henry F. Epstein
*Attorney, Agent, or Firm*—John G. Schenk

[57] ABSTRACT

A flower decoration is disclosed which not only has a decorative effect but also is a useful table accessory. The decoration includes a base which provides a stable support for the sepal and flower portion of the flower. Means are provided for securing the sepal to the base such that the decoration in one embodiment incorporates a plurality of ashtrays as petals and in another embodiment is a candleholder.

3 Claims, 10 Drawing Figures

FLOWER DECORATION

BACKGROUND OF THE INVENTION

This invention relates generally to decorations and more particularly to a flower decoration having special utility as an ashtray holder or candleholder.

There are presently numerous flower decorations available on the market. However, these flower decorations only have utility as a decorative accessory. Similarly, numerous candleholders are available. However, such candleholders likewise only have utility as candleholders. In the same regard, there are numerous ashtray and ashtray holders available. However, once the ashtrays have been removed from the holder, there remains only an empty shell. Such an empty shell is an eyesore and is very often removed from the area or the shell remains in a drawer.

Accordingly, it is an object of this invention to provide a flower decoration which is an attractive article yet has utility as an ashtray holder and candleholder.

Another object of this invention is to provide a flower decoration which serves as an ashtray holder yet remains an attractive accessory when the ashtrays are removed and in use.

Yet another object of this invention is to provide a flower decoration which has a stable base and which does not disclose its utility feature until such time as the host desires to disclose the decoration's utility.

SUMMARY OF THE INVENTION

This invention provides a flower decoration which will serve as a decorative accessory, as well as having utility. The decoration is formed with a base in the shape of a stem and leaves of the flower to provide a stable support for the flower portion. Secured to the upper end of the stem is a bell portion representative of the sepal of a flower. Means are provided for removably holding a plurality of ashtrays in the shape of petals within the bell or for holding the candle within the bell portion.

Other objects, details, uses and advantages of this invention will become apparent as the following description of the exemplary embodiments thereof presented in the accompanying drawings proceeds.

BRIEF DESCRIPTION OF THE DRAWINGS

The accompanying drawings shown present exemplary embodiments of this invention which.

DESCRIPTION OF ILLUSTRATED EMBODIMENTS

Figure 1:
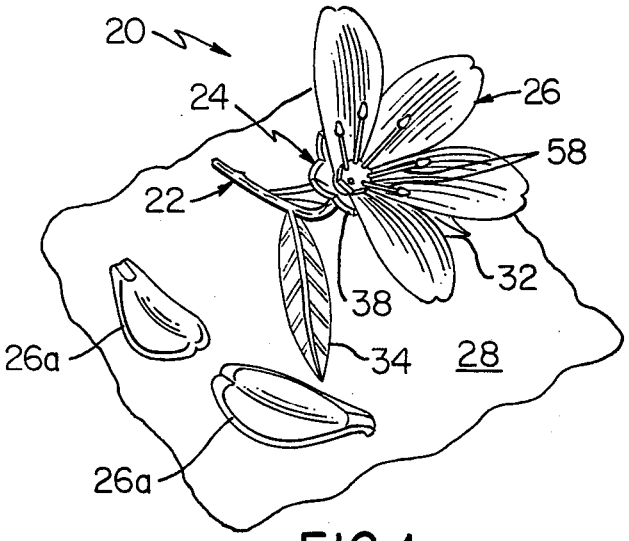
FIG. 1 is a perspective view of a flower decoration of this invention resting on a flat surface.

Reference is now made to FIG. 1 of the drawings, which illustrates one exemplary embodiment of the flower decoration of this invention, which is designated generally by the reference numeral 20. The decoration 20 is comprised generally of a base 22, bell portion 24 and a plurality of petals 26. In FIG. 1 it is seen that the decoration 20 is resting on any suitable surface such as table top 28 and a pair of petals 26a are seen to be resting on the surface 28.

Figure 2:
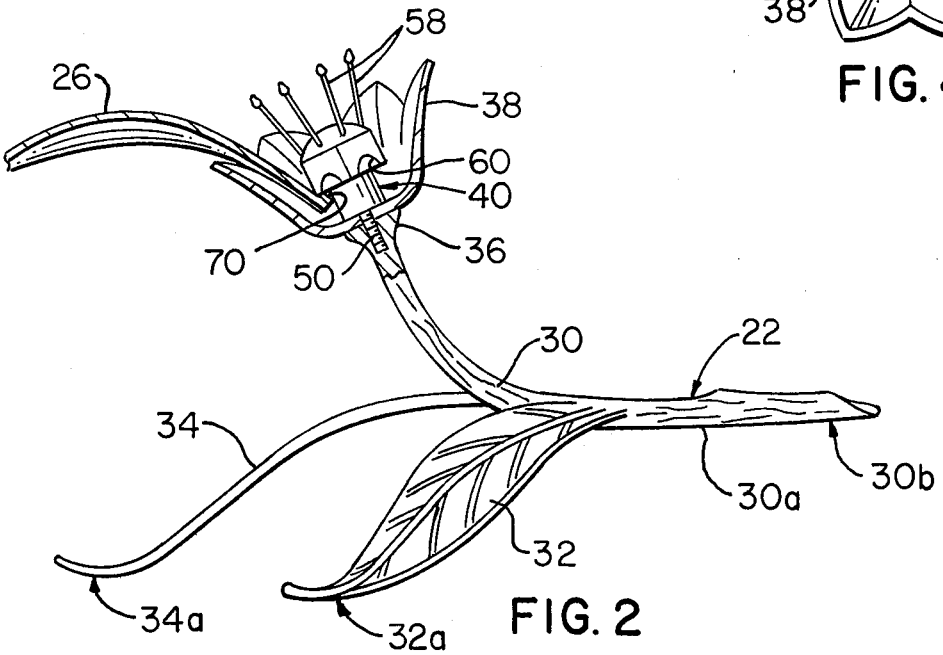
FIG. 2 is a side elevational view of the embodiment of FIG. 1 with a portion of the stem, sepal, and petal in cross section.

As seen more particularly in FIG. 2, the base 22 is comprised of a stem 30 and a pair of leaves 32 and 34. The stem 30 is formed so that the lower portion **30*a* is substantially flat with the surface of a table. Thus, the lower portion of the stem 30*a* and the leaves 32 and 34 provide a three-point support, i.e., at those points designated generally as 30*b*, 32*a* and 34*a***.

The other end of stem 30 projects upwardly and terminates at an enlarged portion 36 generally representative of the receptacle of a flower. A bell portion 38 representative of the sepal portion of a flower is attached to the receptacle portion 36 by any suitable holding means 40.

Figure 3:
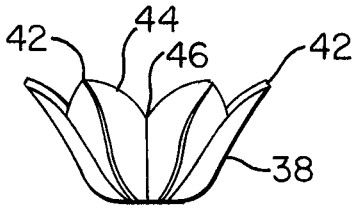
FIG. 3 is an elevational view of the sepal.
Figure 4:
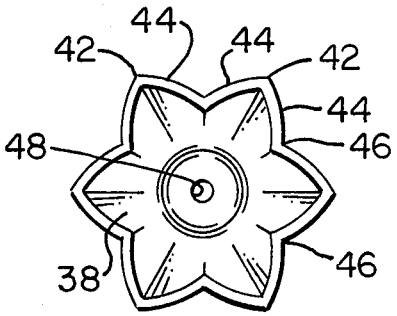
FIG. 4 is a bottom view of the sepal of FIG. 3.

As best seen in FIG. 2–4, the bell portion 38 is generally cup-shaped with the wall thereof curving generally in the outward direction. The peripheral edge of the bell portion 38 is formed of a plurality of outer points or nodes 42 connected by generally sloping edges 44 which meet at inner points or nodes 46. The base of the bell portion 38 is provided with an aperture 48 through which a threaded shank or the like 50 of the nut assembly 52 projects.

Figure 5:
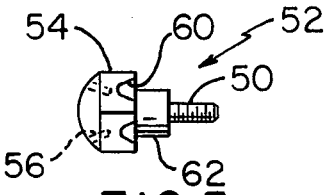
FIG. 5 is an elevational view of the sepal securing means.
Figure 6:
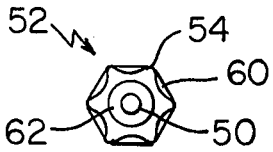
FIG. 6 is a bottom view of FIG. 5.
Figure 7:
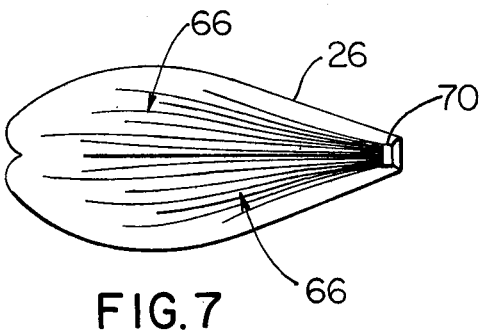
FIG. 7 is a top view of a petal used in the embodiment of FIG. 1.
Figure 9:
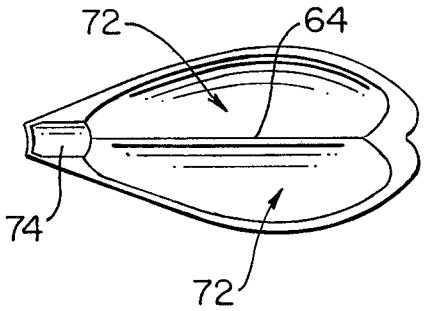
FIG. 9 is a bottom view of the petal of FIG. 7 showing the exterior or outside of the petal.
Figure 8:
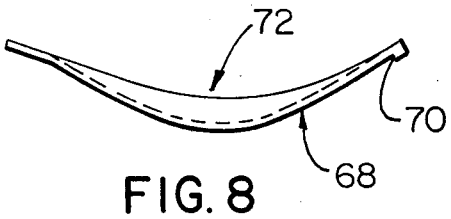
FIG. 8 is a side elevational view of the petal of FIG. 7.

Referring now to FIGS. 5 and 6, it is seen that the bell holding means 40 is comprised of a nut assembly 52 of which the thread portion 50 engages a similarly threaded portion of the receptacle 36. The head 54 of the nut assembly 52 is provided with a plurality of bores 56. The bores 56 securely receive stamen-like rods 58 (FIGS. 1–2). The underside or bottom surface of the head 54 is formed with a plurality of undercuts or indentations 60 which serve to hold one end of the petals 26, as seen in FIG. 2 and described more fully hereinbelow. Spacer portion 62 of the nut assembly 52 engages the inner bottom surface of the bell 38 to hold the bell securedly in position and also positions the head 54 in spaced relation to the base of the bell 38. In the illustrative embodiment herein described, it is seen that the nut assembly 52 is threaded into the receptacle portion 36 of the stem 30. It is obvious that the holding means 40 could be otherwise provided, i.e., the threaded shank portion 50 could be secured in the receptacle portion 36 and the assembly 52 threaded thereonto. The plurality of petals 26 is best seen in FIGS. 7–9. The petals 26 are generally of an elongated oval shape curving upwardly at each end. The petal 26 is formed generally with a rib 64 extending therealong which separates the petal into two generally curvilinear portions. This serves to define a pair of resting surfaces 66 on the inside surface, designated generally as 68 of the petal 26. The inside surface 68 is that surface of the petal 26, as seen in FIG. 1, which would be to the inside of a flower when the petals are closed or not open.

As seen in FIGS. 7 and 8, one end of the petal 26 is formed with a projecting lip or shoulder 70. The projecting lip 70 engages the undercut or indentation 60 of the nut assembly 52, as seen in FIG. 2. When the petal 26 is positioned as shown in FIGS. 1 and 2, the lip 70 engages the indentation 60 and the edges of the petal 26 rest on adjoining edges 44 of adjacent outer points 42. The petal 26 is substantially pivotally mounted on the bell position 38, the pivot point being that portion of the edges 44 which engage the petal 26. As seen in FIG, 2, the greatest portion of the petal 26 extends beyond the bell portion 38 such that the weight of such portion will continuously urge the lip 70 into engagement with the indentation 60, thereby holding each petal in position without the need for additional holding means.

Referring once again to FIGS. 8 and 9, it is seen that when the petal 26 is inverted such that the inside surface 68 faces downwardly, as in FIG. 8, a pair of dished out portions 72 are presented. A groove or channel 74 is formed at one end of the petal 26, one end of said groove communicating with the dished out portions 72. The groove 74 will hold a cigarette therein. Thus, when the petal 26 is removed from the bell portion 38 and placed on a surface in inverted fashion, an ashtray is provided, as illustrated in FIG. 1.

In the illustrative embodiment herein described, it is seen that six petals are provided; thereby it is possible that six ashtrays may be used. Should all six petals be in use as ashtrays, the base 22, bell portion 38 and stamens 58 still provide an attractive decoration. It is also obvious that the decoration 20 can be provided with different sizes and shapes of petals, as well as different numbers of petals. To accomplish different sizes and numbers of petals the bell porttion 38 need only be modified to accept the desired number and the nut assembly 52 modified such that the head portion 54 provides the appropriate number of undercuts or indentations.

As seen in FIG. 2, the stem 30 projects upwardly at an angle less than 90°. It is obvious that this angle may be varied depending on the type flower being represented and the overall effect desired.

Figure 10:
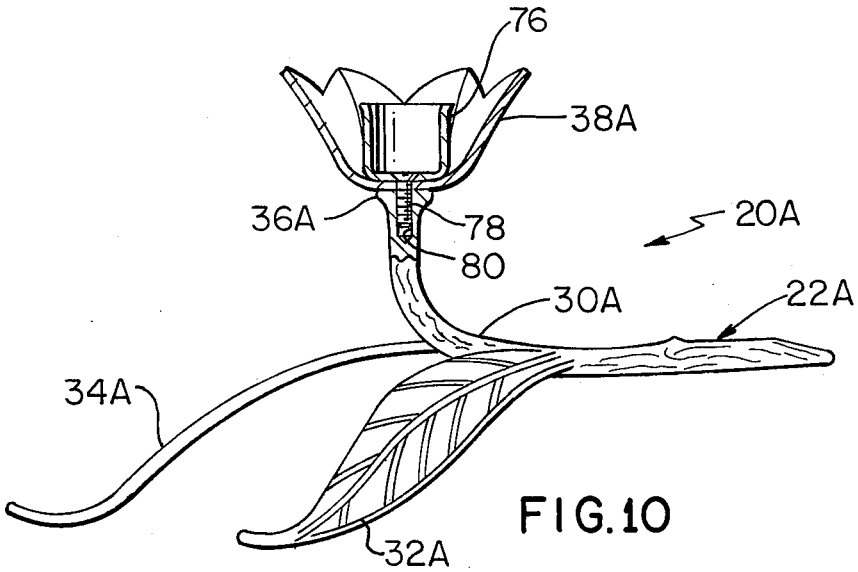
FIG. 10 is an elevational view similar to FIG. 2 showing another embodiment of this invention.

Another exemplary embodiment of this invention is illustrated in FIG. 10 of the drawings. The flower decoration illustrated in FIG. 10 is very similar to the flower decoration 20; therefore, such flower decoration will be designated generally by the reference numeral 20A and the pair of the flower decoration 20A which are similar to corresponding parts of the flower decoration 20 will be designated by the same reference numeral as flower decoration 20 also followed by the letter designation "A" and not described again. The flower decoration 20A is to be used as a candleholder and, therefore, the upper portion of stem 30A projects upwardly in a substantially vertical plane. The angle of the bend of the stem 30A is generally a right angle. The nut assembly 52 of the FIG. 1 embodiment has been replaced with a candleholder 76 substituted therefor. The candleholder 76 is of a universal type and can receive candles of different diameters. A screw 78 projects through an aperture in the holder 76, extends through the aperture of bell portion 38A and is threaded into bore 80. In this way, the bell 38A and holder 76 are securedly fixed to the end of receptacle 36A of the stem 30A. The horizontal portion 22A of the stem, as well as the leaves 32A and 34A provide the stable support for the candle. It should be noted that if a plurality of candles, such as a candleabra, is desired, the base of the candleabra could be mounted within the holder 76 in any suitable manner.

Although the embodiment shown in FIG. 10 only suggests the use of the candleholder without the petals, it should be noted that with a minor modification the petals may also be used when the candle embodiment is used. In this regard, it is only necessary to mount a candleholder, such as 76, to the nut assembly 52. In this case it is only necessary to remove the upper rounded portion of the head 54 and secure the candleholder thereto. Thus, the base of the candleholder is held in spaced relationship from the base of the bell 38A and, as previously described, petals may be placed in holding fashion within the bell 38A.

The flower decoration 20A may be made of any suitable material. As an example, the respective parts may be formed from cast aluminum. The parts may be finished for any desirable appearance. As an example, the aluminum could have a pewter type finish.

It is seen that a flower decoration has been described which serves as an attractive accessory. The decoration also serves as an ashtray holder or a candleholder. Accordingly, the objectives hereinbefore set forth have been accomplished.

While present exemplary embodiments of this invention have been illustrated and described, it will be recognized that this invention may be otherwise variously embodied and practiced by those skilled in the art.

What is claimed is:

1. A flower decoration comprising a base including a stem and a pair of leaves attached thereto and extending outwardly therefrom, one end of said stem and said leaves forming a three-position support, a cup-shaped bell portion representative of the sepal of a flower, and securing means for securing said bell portion to the other end of said stem, said stem extending upwardly from said one end wherein said base, bell portion and securing means are illustrative of a flower, said securing means including a head portion and a spacer portion, said spacer portion engaging the inside bottom surface of said cup-shaped bell portion wherein said head portion is held in spaced relationship to the bottom of said bell portion, a plurality of petal-like members, one end of each of said petal members if formed with a projecting lip, said petal members being positionable at said one end thereof between said bell portion and said head portion, means for holding each of said petal members in detachable fashion wherein said petal members may be individually removed from said bell portion, and in which said holding means is a plurality of indentations formed on the bottom surface of said head portion for receiving said projecting petal lip portion which cooperatively engages said indentation.

2. The decoration as set forth in claim 1 in which said petal member is formed in an elongated oval-shaped configuration, said petal member being substantially dish shaped, wherein said petal member may be inverted when detached from said bell portion whereby providing a receptacle.

3. The decoration as set forth in claim 2 further comprising a groove formed in said petal member in the surface opposite said petal lip wherein said groove forms a receiving groove when said petal member is in the inverted condition.

* * * * *